United States Patent [19]

Dubuc et al.

[11] 4,367,831

[45] Jan. 11, 1983

[54] LOOPER

[76] Inventors: Emile Dubuc, 9141 Bayne, LaSalle (Quebec), Canada, H8R 26G; Maurice Bourgeois, 2315 Guindon St., St. Francois, Laval, Canada, H7R 2YH; Stanley May, 779 44th Ave., LaSalle (Quebec), Canada, H8T 2T7; Robert Zoeller, 835 49th Ave., Lachine (Quebec), Canada

[21] Appl. No.: 322,221

[22] Filed: Nov. 17, 1981

Related U.S. Application Data

[63] Continuation of Ser. No. 92,075, Nov. 5, 1979, abandoned.

[51] Int. Cl.[3] ..... B65H 25/00

[52] U.S. Cl. ..... 226/14; 226/104; 200/61.44

[58] Field of Search ..... 226/14, 104–107, 226/118, 119; 198/153, 177; 200/61.42, 61.44

[56] References Cited

U.S. PATENT DOCUMENTS

| | | | |
|---|---|---|---|
| 1,880,820 | 10/1932 | Conant | 226/14 |
| 2,035,227 | 3/1936 | Fowler | 226/14 |
| 2,641,469 | 6/1953 | Pagell | 226/14 |
| 2,710,319 | 6/1955 | Bush | 200/61.44 |
| 3,008,620 | 11/1961 | Hausner et al. | 226/14 |
| 3,151,797 | 10/1964 | Brownell | 226/107 |

*Primary Examiner*—Leonard D. Christian

*Attorney, Agent, or Firm*—Roylance, Abrams, Berdo & Farley

[57] ABSTRACT

A looper used in the manufacture of asphaltic roofing felt comprising a driven endless belt of spaced tubes adapted to carry loops of felt between adjacent tubes, a track inclined toward said loops, a trolley having fingers adapted to contact the foremost loop in the looper, rollably mounted on the track wherein the improvement comprises a chain driven at the same rate and in the same direction as said endless belt and means on said trolley to interlock with said chain actuated when said fingers have contacted the foremost loop whereby the trolley travels with the foremost loop and the fingers maintain a constant pressure or contact on the foremost loop, until the loop is pulled out of the reach of the fingers, whereby the fingers drop and deactuate the interlock means, allowing the trolley to roll by force of gravity until the fingers again contact the foremost loop and the operation is repeated.

12 Claims, 3 Drawing Figures

LOOPER

This application is a continuation of application Ser. No. 92,075, filed Nov. 5, 1979 now abandoned.

BACKGROUND OF THE INVENTION

1. Field of the Invention

The present invention relates to the manufacture of roofing felt and in particular relates to an improved looper apparatus.

2. Prior Art

The basic roofing felt is first manufactured on a paper machine in rolls of approximately 5 feet diameter. The felt is then saturated in asphalt and wound into small diameter rolls for distribution to the roofing industry.

To achieve the penetration of asphalt into the felt for roofing, the 5 feet diameter roll is unwound through a series of hot asphalt sprays, into a hot tank of asphalt and then through a series of strike-in rolls for final penetration. From the strike-in, the sheet of felt, is slowed down and hung in loops in a cooling looper until the product is cold enough to be pulled into the high speed winder. The winder will then meter the length, cut and wind the felt into tight 9" diameter rolls ready for market.

After the felt has been impregnated in the saturating section, it is hung in loops in the cooling looper. The looper slows down the product to a slower speed. After several minutes in the looper, each loop in turn, is pulled or snatched out of the looper bars at a very high speed.

To keep the loops hanging squarely in the looper and to prevent loop dancing with subsequent felt damage, a free running gravity trolley presses lightly against the product.

As the prior art looper chain pulls forward and the loop is removed the trolley moves by gravity to the next loop and so forth. So long as the fingers engage a loop, the trolley is pushed back up the slight incline of the side rails on which it rides by the movement of chain loop which carries the loop in the direction of the winder.

The prior art method and apparatus is illustrated in U.S. Pat. No. 1,880,820.

Since there are many operating variations, the normal free running trolley can press too hard against the sheet and cause damage and cracking in the bottom fold as the loop is pulled out. This cracking may not be detected sometimes and will later show up as a breakdown in the roof.

It is an advantage of the present invention that the trolley is controlled and provides a constant and non-excessive pressure against the hanging loops. It is a feature of the present invention that the trolley moves with the engaged loop. These and other advantages and features will become apparent from the following discussion.

SUMMARY OF THE INVENTION

Briefly, the present invention is an improvement in the looper apparatus used in the manufacture of asphalt impregnated roofing felt comprising a zone having an endless driven belt of spaced tubular members adapted to carry hanging loops of asphalt impregnated felt between pairs thereof, and a trolley rollably mounted on a track inclined toward said loops and having means extending from said trolley to contact the foremost loop in said zone by the attraction of gravity on said trolley along said inclined track, wherein the improvement comprises a driven chain geared to said driven belt to drive said chain at the same rate and in the same direction as said driven belt, means on said trolley for releasably interlocking said trolley with said driven chain thereby to move said trolley with said driven chain and means operably associated with said means for contacting the foremost loop for actuating said means for releasably interlocking with said driven chain. The trolley is also an aspect of the present invention.

When the means for contacting the foremost loop in the zone for example, a set of fingers, contacts the foremost loop the pull of gravity draws the trolley toward the loop until the fingers have rotated about a pivot, as a result of the resistance of the foremost loop, a predetermined distance to contact a means, for example, an electric switch, which activates a brake associated with a free wheeling sprocket mounted to the trolley, which engages the driven chain thereby causing the sprocket to be prohibited or prevented from rotating and hence to thereby interlock the trolley to the driven chain such that the trolley is moved back up the inclined track at the same rate as the foremost loop advances in the zone. When the foremost loop is pulled out of the zone the fingers are released and drop thereby releasing the switch and the brake is deactivated allowing the sprocket to freewheel and the trolley to roll down the inclined track until the fingers contact the next foremost loop in the zone, repeating the operation described above.

In a specific embodiment, the trolley comprises two pairs of fore and aft wheels with a simple chassis. The wheels run on rails that are inclined from the horizontal sufficiently for gravitation forces to push the trolley lightly against the looped sheet. A linear roller chain, which runs in the rail and is geared to the main looper chains, maintains the same linear speed as the looper. An endless chain serves quite well for this purpose. Mounted transversely in the trolley is a shaft with a disc brake and an 11" diameter, 1" pitch sprocket meshing with the linear chain.

As each loop is pulled out the trolley is disengaged from the main drive chain and allowed to glide down to the next loop. The trolley fingers will sense the next loop and the machine locks in again to the driven chain thus maintaining its position again without crushing this loop.

This mechanical monitoring action is achieved by sensing the rise and fall of the trolley fingers. As the loop rises out of the looper, the fingers will lower and the trolley is automatically disengaged from drive to free running. Upon contact with the next loop the fingers will rise and activate the switch to lock into the drive, thus maintaining the trolley position for this loop.

During the "pull-out" of each loop the trolley fingers will maintain a predetermined angle, for example, as the loop rises out of the looper, the fingers fall, changing the angle. This change is sensed by a limit switch to release the disc brake. Releasing the brake allows the 11" sprocket to freewheel on the linear chain, which in turn allows the trolley to glide down the rails to the next loop. This next loop will correct the angle back to the predetermined angle, for example, 75° by pushing up the trolley fingers. The brake is reenergized to lock in the sprocket, which causes the trolley to run backwards at the looper main chain speed again.

This interlocking action monitors and maintains the trolley position against the hanging loops without crushing or damaging the felt.

As used herein, the term "foremost loop" refers to the loop nearest the trolley and which may be contacted and engaged by the fingers. Hence, a loop which has been partially withdrawn from the zone and which is above the reach of the fingers, is not foremost even though it may be first in the zone.

DETAILED DESCRIPTION AND PREFERRED EMBODIMENT

Figure 1:
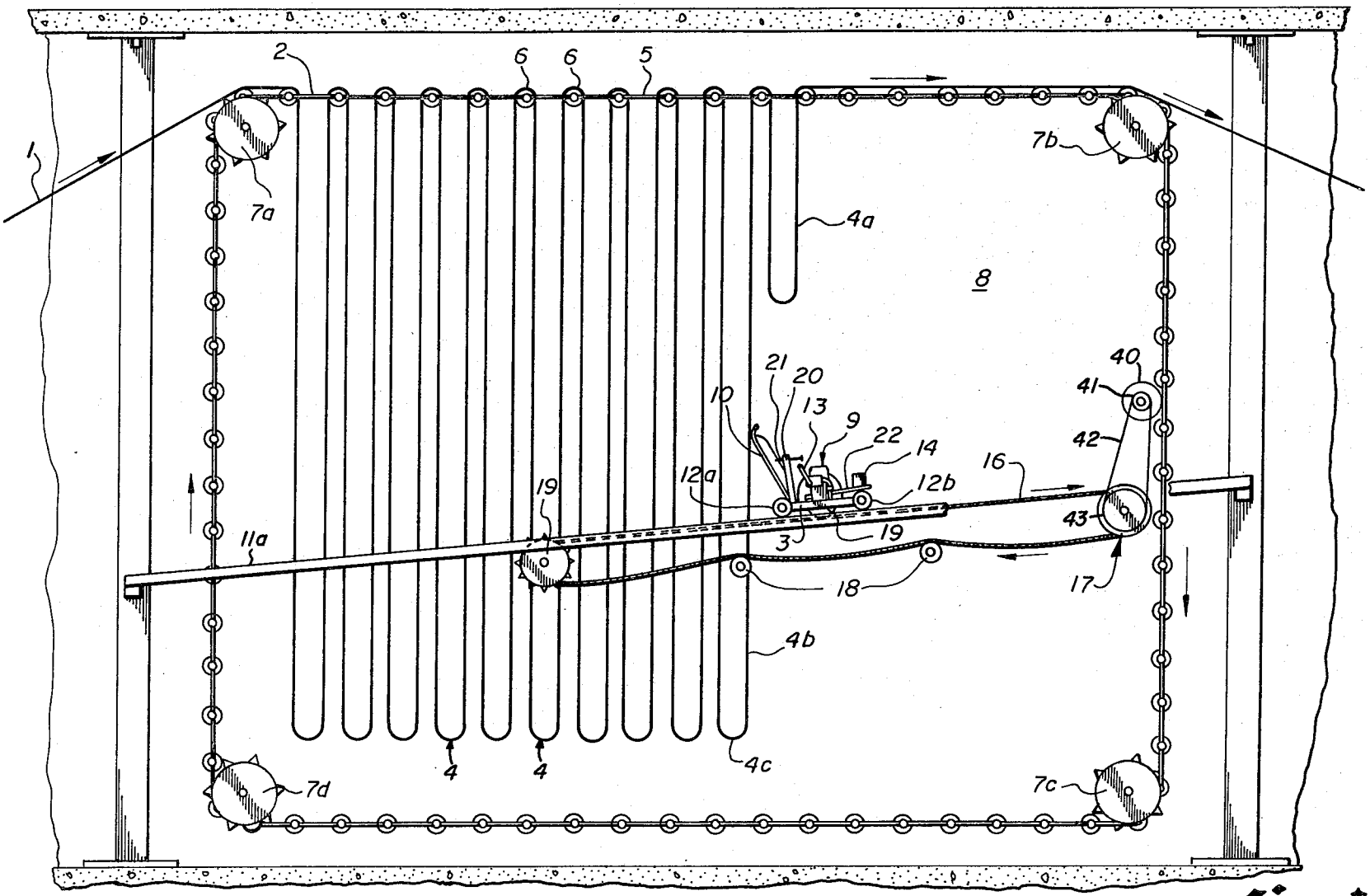
FIG. 1 is a elevational view of one embodiment of the looper and the improvement in the operation of the trolley according to the present invention.

In FIG. 1, the chamber or zone 8 in which the loops suspended is depicted. The principal feature of this zone is the endless belt 2, composed of a series of lateral tubular members 6 spaced apart by links 5 as known in the art. The endless belt is moved in a path about the chamber 8 from sprocket 7*a* to 7*b* to 7*c* to 7*d* and past 7*a* again in direction of the arrows adjacent to the belt. The drive means for the endless belt is not depicted; it may be, however, any of sprockets 7.

The felt 1 in the zone 8 is dropped or hung between adjacent pairs of tubular members or rollers 6 to form loops 4. The felt is pulled from chamber by a take up roll (not shown) to the right of FIG. 1. As depcited the felt from the loop 4*a* is withdrawn as the loops 4 are moved by means of endless driven belt 2 in the direction of the take up roll.

The trolley 9 is mounted on a pair of inclined rails 11 on fore and aft wheels 12*a* and 12*b* respectively, mounted on frame 3. Fingers 10 are pivotally mounted in the frame 3 and are free to move a distance toward the loops. As shown in FIG. 1 the fingers 10 are engaged with the foremost loop 4*b* in the chamber (loop 4*a* being in the process of being pulled out).

The trolley 9 rides on rails 11 which are inclined toward the loops on either side of the chamber 8 such that trolley will roll toward the loops, when it is free to do so, by the pull of gravity. As shown in FIG. 1, the fingers 10 are engaged with the foremost loop 4*b* and are pivoted toward the direction of movement, thereby bringing the threaded bolt 21 (attached to member 20 which is affixed in relationship to the fingers) into contact with limit switch 13, which when contacted by the bolt 21 activates an electric disc brake 29 (FIG. 2) operably associated with engaging sprocket 15.

The engaging sprocket 15 is engaged with driven chain 16. Actuation of the electric disc brake prevents rotation of the otherwise freewheeling engaging sprocket 15 thereby interlocking the trolley to the driven chain 16. The driven chain is driven about sprockets 17 and 19 and over support rollers 18, at the same linear rate and in the same direction as the endless belt 2. This is accomplished by a roller 40 which is rotated by endless belt 2 and which has a drive pulley 41 rigidly coupled thereto and interconnected via a belt 42 to a driven pulley 43, which is in turn rigidly coupled to sprocket 17. Thus, the fingers 10 apply the same pressure to the loop 4*b* as the entire assembly of endless belt and trolley move toward the right of FIG. 1 at the same rate. When the loop 4*b* is pulled from the zone and it rises above the fingers 10 which drop, thereby disengaging from the switch 13 and deactivating the brake, allowing the engaging sprocket 15 to become free wheeling, while still engaging the chain. Thus, freed, the trolley will roll by the pull of gravity down the inclined rails 11 until the fingers again contact the foremost loop and the entire cycle is repeated.

Figure 2:
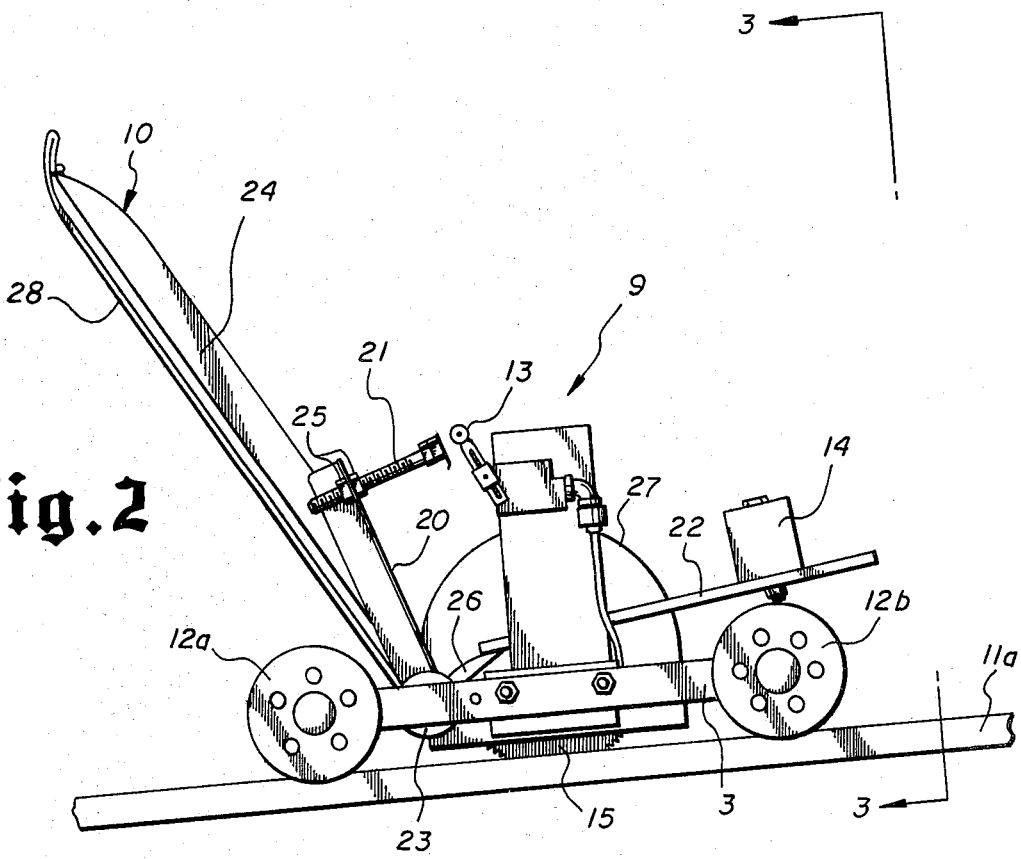
FIG. 2 is an elevational side view of one embodiment of the trolley according to the present invention.

FIG. 2 discloses the trolley 9 from FIG. 1 in greater detail. The fingers 10 are shown to comprise a plate portion 28 which is curved at its upper extremity to prevent snagging of the felt and a rib 24 to reinforce the plate. The fingers are affixed to a hub or shaft 23, which is rotatably mounted in frame 3. The member 20 is also affixed to the hub and has threaded bolt 21 adjustably positioned therein with nuts 25. The extremity of the bolt 21 is aligned with limit switch 13 and will contact and depress the switch as the fingers 10 have contacted the foremost loop in the zone and have rotated the hub and member 20 toward the limit switch.

Figure 3:
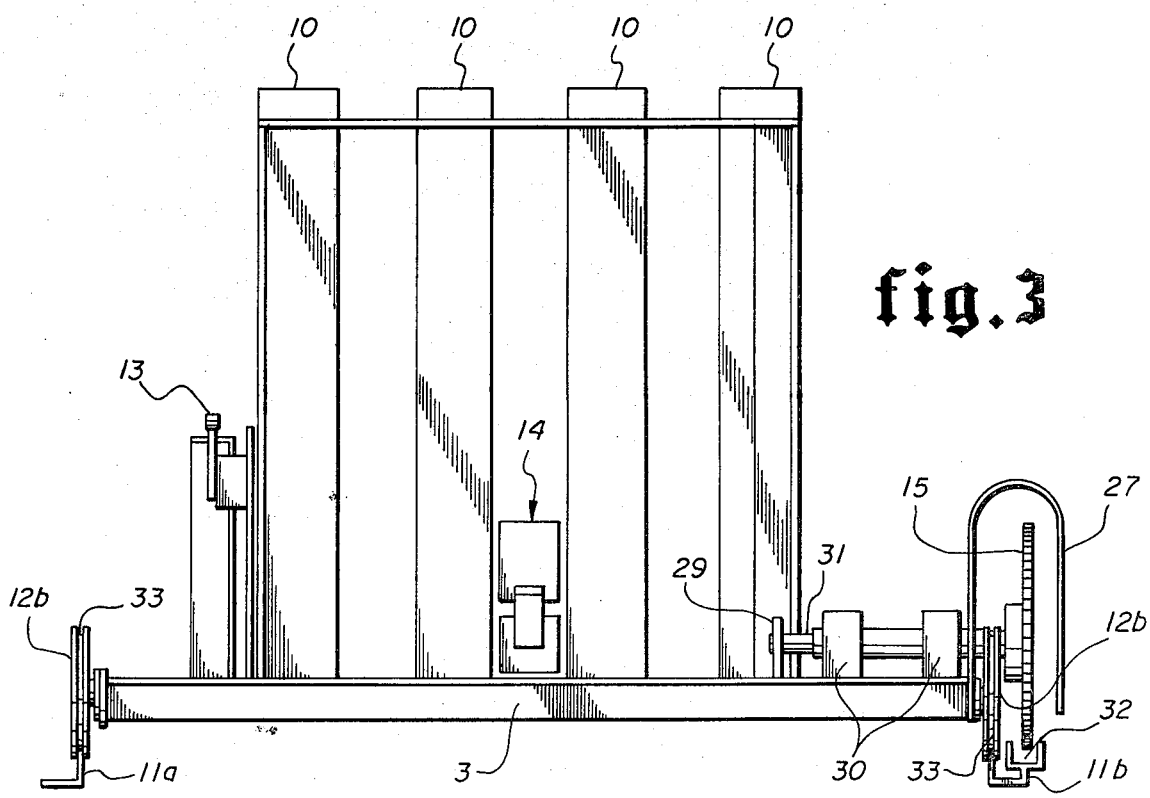
FIG. 3 is a rear elevational view of the trolley of FIG. 2 from 3—3.

Turning to FIG. 3, the arrangement for interlocking the trolley to the chain can be seen. The limit switch 13 is operably connected to the braking means 29 (an electric disc brake is expedient) disposed on the shaft 31 to which the engaging sprocket 15 is affixed and supported through pillow blocks 30. Since the engaging sprocket engages the driven chain 16 at all times, braking of the spocket interlocks the sprocket and hence the trolley to the chain at a given point.

The fingers 10 are pivoted near the forward end of the trolley and a counter weight 14 is mounted to platform 22 which extends rearward. A lip 26 connected to hub 23 contacts an end of platform 22 and limits the distance which fingers 10 may fall or pivot toward the loops when not in contact with the foremost thereof. A housing 27 is provided over the engaging sprocket and in FIG. 3 it is cut away to expose the engaging sprocket 15.

The rails 11*a* and 11*b* fit in the recesses or annular grooves 33 on each wheel 12. Rail 11*b* also comprises a channel 32 which is attached thereto and in which the driven chain 16 moves. The engaging sprocket 13 engages the chain 16 in the channel 32.

It is readily apparent that some mechanistic changes or reversal of parts will serve to produce an equivalent function in the present invention. For instance, the limit switch could be mounted on the member 20. These obvious permutations are contemplated as embodiments of the present invention.

We claim:

1. In a looper apparatus used in the manufacture of asphalt impregnated roofing felt including a chamber, an endless driven belt movable through the chamber and including spaced tubular members adapted to carry hanging loops of asphalt impregnated felt between pairs thereof, a trolley rollably mounted on a track in the chamber and inclined toward the felt loops, and means extending from the trolley for contacting the foremost loop in the chamber under the influence of gravity acting upon the trolley located on the inclined track, the improvement comprising:

a driven chain mounted in said chamber and coupled to said endless driven belt for movement thereby at the same rate and in the same direction as said endless driven belt;

means, on said trolley, for releasably coupling said trolley to said driven chain; and means, coupled to said means extending from said trolley for contacting the foremost loop in the chamber, for activating said means for releasably coupling said trolley to said driven chain to thereby move said trolley with said driven chain.

2. The looper apparatus according to claim 1, wherein said driven chain is endless.

3. The looper apparatus according to claim 2, wherein said trolley has a plurality of wheels rotatably coupled thereto and seated on said inclined track.

4. The looper apparatus according to claim 2, wherein said means for releasably coupling said trolley to said driven chain includes a freewheeling sprocket rotatably coupled to said trolley, and break means, coupled to said trolley and said freewheeling sprocket, for preventing rotation of said freewheeling sprocket.

5. The looper apparatus according to claim 4, wherein said means for activating said means for releasably coupling includes a limit switch.

6. The looper apparatus according to claim 4, wherein said means extending from said trolley for contacting the foremost loop in the chamber comprises a plurality of fingers pivotally coupled to said trolley.

7. The looper apparatus according to claim 1, wherein said means extending from said trolley for contacting the foremost loop in the chamber comprises a plurality of fingers pivotally coupled to said trolley, said means for activating said means for releasably coupling includes a limit switch, said plurality of fingers having a member coupled thereto and movable therewith when said fingers contact the foremost loop for contacting said limit switch.

8. The looper apparatus according to claim 7, whrein said means for releasably coupling said trolley to said driven chain includes a freewheeling sprocket rotatably coupled to said trolley and engaging said driven chain, and brake means, coupled to said trolley and said freewheeling sprocket, for preventing rotation of said freewheeling sprocket.

9. The looper apparatus according to claim 8, wherein said brake means comprises an electrical brake.

10. The looper apparatus according to claim 8, wherein said chamber has a channel defined therein carrying said driven chain below said freewheeling sprocket.

11. The looper apparatus according to claim 8, wherein said trolley includes a shaft coupled to said freewheeling sprocket and to said brake means.

12. A trolley comprising:

a frame;

four wheels mounted to said frame and adapted to seat on a track;

a set of fingers pivotally mounted to said frame and extending away from said frame;

a member coupled to and movable with said fingers;

an electric limit switch mounted to said trolley and aligned for contact with said member upon movement of said fingers;

an electric brake actuatable by said electric limit switch upon contact with said member; and a freewheeling sprocket rotatably mounted to said frame and lockable against rotation by actuation of said electric brake, said freewheeling sprocket being adapted to be engaged with a driven chain which thereby provides locomotion to said trolley when said freewheeling sprocket is locked and allows movement of said trolley free of the driven chain when said freewheeling sprocket is not locked.

* * * * *